US007712885B2

(12) United States Patent
Kojima

(10) Patent No.: US 7,712,885 B2
(45) Date of Patent: May 11, 2010

(54) LIQUID-DROPLET JETTING APPARATUS

(75) Inventor: Masatomo Kojima, Ichinomiya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 691 days.

(21) Appl. No.: 11/590,727

(22) Filed: Oct. 31, 2006

(65) Prior Publication Data

US 2007/0109373 A1 May 17, 2007

(30) Foreign Application Priority Data

Oct. 31, 2005 (JP) ..... 2005-316895

(51) Int. Cl.
*B41J 2/17* (2006.01)

(52) U.S. Cl. ..... 347/94; 347/84; 347/54; 347/65

(58) Field of Classification Search ..... 347/94, 347/84, 54, 65
See application file for complete search history.

(56) References Cited

U.S. PATENT DOCUMENTS

2001/0002839 A1* 6/2001 Ishii ..... 347/71
2002/0196315 A1* 12/2002 Isono et al. ..... 347/71

FOREIGN PATENT DOCUMENTS

JP 11-309877 11/1999
JP 2003-127354 5/2003

* cited by examiner

*Primary Examiner*—Stephen D Meier
*Assistant Examiner*—Laura E Martin
(74) *Attorney, Agent, or Firm*—Eugene Ledonne; Joseph W. Treloar; Frommer Lawrence & Haug LLP

(57) ABSTRACT

A liquid-droplet jetting apparatus includes a first common liquid chamber which supplies a liquid to first pressure chambers communicating with first nozzles and extending in a predetermined direction; and a second common liquid chamber which supplies a liquid to second pressure chambers communicating with second nozzles and extending in the predetermined direction. The first and second common liquid chambers are overlapped in a plan view, and each having a substantial width. A damper for attenuating pressure wave which propagates to the first and second common liquid chambers is formed at a portion in which the first and second common liquid chambers are overlapped. Each of the first common liquid chamber, the second common liquid chamber and the damper is formed to have a width overlapping with one of the first and second pressure chambers, thereby making it possible to attenuate the pressure wave efficiently.

20 Claims, 8 Drawing Sheets

LIQUID-DROPLET JETTING APPARATUS

CROSS REFERENCE TO RELATED APPLICATION

The present application claims priority from Japanese Patent Application No. 2005-316895 filed on Oct. 31, 2005, the disclosure of which is incorporated herein by reference in its entirety.

BACKGROUND OF THE INVENTION

1. Field of the Invention

The present invention relates to a liquid-droplet jetting apparatus which jets a liquid droplet from a jetting port.

2. Description of the Related Art

In an ink-jet head (liquid-droplet jetting apparatus) which jets an ink from jetting ports of nozzles by applying pressure to the ink in pressure chambers, when pressure is applied to the ink in a certain pressure chamber among the pressure chambers, pressure wave is generated in the pressure chamber, and the generated pressure wave is propagated to a common liquid chamber communicating with the pressure chambers. This pressure wave is attenuated in the common liquid chamber to prevent the pressure wave from propagating further to another pressure chamber, thereby suppressing the variation in ink-jetting characteristics such as change in droplet speed. For example, an ink-jet type recording head (ink-jet head) described in Japanese Patent Application Laid-open No. 2003-127354, a plurality of pressure generating chambers (pressure chambers) communicating with nozzles respectively are communicated with an ink storage chamber (common liquid chamber) via ink supply channels, respectively; and a recess is formed in a head case at an area corresponding to the ink storage chamber. Further, a metallic vibration plate has an area overlapping with the area of the head case at which the recess is formed, and this area of the vibration plate functions as a damper which releases the pressure variation (damps or attenuates the pressure wave) in the ink storage chamber.

However, with respect to the ink-jet head described in Japanese Patent Application Laid-open No. 2003-127354, when an attempt is made to realize the high densification and miniaturization of the ink-jet head, it is necessary to decrease the size of the common liquid chamber, and if the common liquid chamber is decreased in size, there is a fear that the pressure wave is not sufficiently attenuated in the common liquid chamber. In such a case, it is conceivable to form a member, such as the vibration plate which functions as the damper, of a material with a low elasticity such as polyimide. This, however, in turn causes a problem such that, when this member is heated together with another member made of metal and joined to the another member, warpage deformation occurs due to the difference in linear expansion coefficient between the members.

An ink-jet head described in Japanese Patent Application Laid-open No. 11-309877 is provided with two reservoirs which supply an ink to pressure generating chambers communicating with nozzles, respectively, such that the reservoirs are overlapped in an up and down direction. The two reservoirs are partitioned by a partition plate which is provided with a pressure-absorbing section for absorbing a pressure wave generated when the ink droplets are discharged and directed in a direction opposite to openings of the nozzles. The partition wall is formed by joining a thin plate and a sealing plate which has a recess formed therein, and the pressure wave is absorbed by the thin plate and a thin wall defining the recess.

SUMMARY OF THE INVENTION

An object of the present invention is to provide a liquid-droplet jetting apparatus which is capable of effectively attenuating the pressure wave in the common liquid chamber.

According to a first aspect of the present invention, there is provided a liquid-droplet jetting apparatus which has a body and which jets liquid droplets of a liquid, including: a plurality of first pressure chambers; a first pressure-chamber row in which the first pressure chambers are arranged in a first direction; a plurality of second pressure chambers; a second pressure-chamber row in which the second pressure chambers are arranged in the first direction; a first common liquid chamber which extends in the first direction and which communicates with each of the first pressure chambers; a second common liquid chambers which extends in the first direction and which communicates with each of the second pressure chambers; and a damper which extends in the first direction and which is located between the first and second common liquid chambers in a thickness direction of the body; wherein the first common liquid chamber has a width in a second direction, which is orthogonal to the first direction, so as to overlap with the second common liquid chamber in the thickness direction; the damper has a width in the second direction so as to overlap with each of the first and second common liquid chambers in the thickness direction; and each of the first common liquid chamber, the second common liquid chamber and the damper has the width in the second direction so as to overlap in the thickness direction with the first pressure-chamber row and the second pressure-chamber row.

The capacity of the damper to attenuate or damp the pressure wave greatly depends on a planar area of the damper. When a damper extends in a certain direction, as a width thereof in a short direction (length in the second direction) of the damper is greater, the attenuating capacity becomes greater than in a case in which the area is same but the width in the short direction is smaller. According to the liquid-droplet jetting apparatus of the present invention, the second common liquid chamber is formed such that the second common liquid chamber overlaps at least partially with the first common liquid chamber in the thickness direction of the body, it is possible to increase a length, of each of the first and second common liquid chambers, in the second direction. Therefore, it is possible to increase also the length, in the second direction, of the damper formed in the portion at which the first and second common liquid chambers are overlapped. Further, each of the first and second common liquid chambers and the damper is formed so as to partially overlap with the first and second pressure chambers. Accordingly, it is possible to secure a sufficiently great width for the first and second common liquid chamber and the damper, and to substantially increase acoustic capacitance in the first and second common liquid chambers, thereby making it possible to efficiently attenuate the pressure wave in the first and second common liquid chambers.

In the liquid-droplet jetting apparatus of the present invention, the damper may include: a first thin-walled portion which forms a wall surface of the first common liquid chamber; a first damper chamber in which a part of a wall surface thereof is defined by the first thin-walled portion and which has rigidity lower than that of the first thin-walled portion; a second thin-walled portion which forms a wall surface of the second common liquid chamber; and a second damper chamber in which a part of a wall surface thereof is defined by the second thin-walled portion and which has rigidity lower than that of the second thin-walled portion. According to this construction, it is possible to increase the length, of each of the first and second thin-walled portions and the first and second damper chambers, in the second direction. Accordingly, it is possible to substantially increase acoustic capacitance in the first and second common liquid chambers, thereby making it possible to efficiently attenuate the pressure wave in the first and second common liquid chambers.

In the liquid-droplet jetting apparatus of the present invention, the first thin-wall portion may define the wall surface, of the first common chamber, which faces the second common liquid chamber; the second thin-wall portion may define the wall surface, of the second common chamber, which faces the first common liquid chamber; and the first damper chamber and the second damper chamber may be integrated to form an integrated damper chamber. In this case, by forming the first thin-walled portion and the second thin-walled portion between the first common liquid chamber and the second common liquid chamber, it is possible to form an integrated chamber in which the first and second damper chambers are integrated. Therefore, it is possible to decrease the number of parts than in a case where the first and second damper chambers are formed separately.

In the liquid-droplet jetting apparatus of the present invention, the first thin-walled portion may be a thinned portion, in a first flat plate, defined by a first recess which is formed on a surface, of the first flat plate, opposite to the first common liquid chamber; and the second thin-walled portion may be a thinned portion, in a second flat plate, defined by a second recess which is formed on a surface, of the second flat plate, opposite to the second common liquid chamber. In this case, by forming the first recess in the first flat plate, the first thin walled portion is formed and the first recess becomes the first damper chamber. Therefore, it is possible to form the first thin-walled portion and the first damper chamber with one member. Further, by forming the second recess in the second flat plate, the second thin-walled portion is formed and the second recess becomes the second damper chamber. Therefore, it is possible to form the second thin-walled portion and the second damper chamber with one member. This makes it possible to decrease the number of parts.

In the liquid-droplet jetting apparatus of the present invention, a spacer may be intervened between the first thin-walled portion and the second thin-walled portion; and a thickness of the spacer may be same as a thickness of the integrated damper chamber. In this case, it is possible to easily form the integrated damper chamber by providing a spacer between the first and second thin-walled portions.

In the liquid-droplet jetting apparatus of the present invention, the first and second damper chambers may communicate with outside air. In this case, it is possible to prevent the damage of the liquid-droplet jetting apparatus which would be otherwise caused by the thermal expansion of air in the first and second damper chambers due to heating during the production process.

In the liquid-droplet jetting apparatus of the present invention, a plurality of first jetting ports communicating with the first pressure chambers respectively and a plurality of second jetting ports communicating with the second pressure chambers respectively may be formed in a side surface of the body. According to this construction, since the jetting ports are formed in a same plane, the liquid-droplet jetting characteristics hardly vary among the plurality of jetting ports.

In the liquid-droplet jetting apparatus of the present invention, each of the first pressure chambers and each of the second pressure chambers may be formed along a side surface of the body. According to this construction, the plurality of the pressure chambers is formed along a same plane. Therefore, it is possible to arrange an energy applying mechanism, which forms a wall of each of the pressure chambers, on a same plane, thereby making it possible to reduce the number of parts.

The liquid-droplet jetting apparatus of the present invention may further include an energy applying mechanism which applies jetting energy to each of the first pressure chambers and to each of the second pressure chambers; wherein the energy applying mechanism may include a piezoelectric layer which faces each of the first pressure chambers and each of the second pressure chambers, and a pair of electrodes which applies electric field to the piezoelectric layer. In this case, it is possible to apply the jetting energy to the liquid in the pressure chambers with a simple construction including the piezoelectric layer and the pair of electrodes.

In the liquid-droplet jetting apparatus of the present invention, the first common liquid chamber may be formed as a plurality of first common liquid chambers arranged in the second direction; the first thin-walled portion may be formed as a plurality of first thin-walled portions each of which forms a wall surface of one of the first common liquid chambers, and the first damper chamber may be formed as a plurality of first damper chambers in each of which a portion of a wall surface thereof is defined by one of the first thin-walled portions; the second common liquid chamber may be formed as a plurality of second common liquid chambers arranged in the second direction; and the second thin-walled portion may be formed as a plurality of second thin-walled portions each of which forms a wall surface of one of the second common liquid chambers, and the second damper chamber may be formed as a plurality of second damper chambers in each of which a portion of a wall surface thereof is defined by one of the second thin-walled portions. According to this construction, since the first common liquid chambers are formed at positions which are same in the thickness direction of the body, the rigidity is made to be uniform (uniformized) at portions around the first common liquid chambers, respectively. Therefore, the liquid-droplet jetting characteristics are made to be uniform among the jetting ports communicating with the first common liquid chambers, respectively. In a similar manner, since the second common liquid chambers are formed at positions which are same in the thickness direction of the body, the rigidity is made to be uniform at portions around the second common liquid chambers, respectively. Therefore, the liquid-droplet jetting characteristics are made to be uniform among the jetting ports communicating with the second common liquid chambers, respectively.

In the liquid-droplet jetting apparatus of the present invention, the liquid may include liquids of different kinds, and the liquids of different kinds may be supplied to the first common liquid chambers and the second common liquid chambers, respectively. In this case also, since the liquid-droplet jetting characteristics are made to be uniform among the jetting ports, respectively, which are communicated with each of the common liquid chambers, it is possible to uniformize the jetting characteristics of the jetting ports for the same liquid.

The liquid-droplet jetting apparatus of the present invention may further include: a first dummy common liquid chamber which is adjacent to the first common liquid chambers in the second direction and which extends in the first direction; a second dummy common liquid chamber which is adjacent to the second common liquid chambers in the second direction and which extends in the first direction; a first dummy thin-walled portion which defines a wall surface of the first dummy common liquid chamber; a first dummy damper chamber in which a part of a wall surface thereof is defined by the first dummy thin-walled portion and which has rigidity lower than that of the first dummy thin-walled portion; a second dummy thin-walled portion which defines a wall surface of the second dummy common liquid chamber; and a second dummy damper chamber in which a part of a wall surface thereof is defined by the second dummy thin-walled portion and which has rigidity lower than that of the second dummy thin-walled portion; wherein: one of the second common liquid chambers may have a width in the second direction so as to overlap at least partially with the first dummy common liquid chamber in the thickness direction; and one of the first common liquid chambers may have a width in the second direction so as to overlap at least partially with the second dummy common liquid chamber in the thickness direction. According to this construction, the first dummy common liquid chamber, the first dummy thin-walled portion, and the first dummy damper chamber are formed so as to overlap with one second liquid common chamber, which is among the second common liquid chambers and which overlaps, in the thickness direction, with none of the first common liquid chambers, thereby making it possible to make rigidity at a portion around this second common liquid chamber to be close to the rigidity at a portion around each of the remaining second common liquid chambers overlapping with the first common liquid chambers, respectively. Therefore, the rigidity is made to be uniform at portions around the second common liquid chambers, and thus the jetting characteristics are made uniform among the jetting ports communicating with the second common liquid chambers, respectively. Similarly, the second dummy common liquid chamber, the second dummy thin-walled portion, and the second dummy damper chamber are formed so as to overlap with one first liquid common chamber, which is among the first common liquid chambers and which overlaps in the thickness direction with none of the second common liquid chambers, thereby making it possible to make rigidity at a portion around this first common liquid chamber to be close to the rigidity at a portion around each of the remaining first common liquid chambers overlapping with the second common liquid chambers, respectively. Therefore, the rigidity is made to be uniform at portions around the first common liquid chambers, respectively, and thus the jetting characteristics are made uniform among the jetting ports communicating with the first common liquid chambers, respectively.

In the liquid-droplet jetting apparatus of the present invention, each of the first and second common liquid chambers and each of the first and second dummy common liquid chambers may have a constant-width area in which a length in the second direction is constant, and a narrowing area which is continued to the constant-width area and in which a length in the second direction is reduced toward an end in the first direction thereof. In this case, the length, of each of the first and second common liquid chambers, in the second direction is shortened (narrowed) toward an end portion in the first direction of the narrowing area. Therefore, the flow of the liquid easily occurs in this end portion, thereby making it possible to supply the liquid assuredly also to jetting ports, among the jetting ports, communicating with one of the first and second common liquid chambers at the end portion in the first direction thereof.

The liquid-droplet jetting apparatus may further include: a plurality of third dummy common liquid chambers each of which is adjacent, in the first direction, to the narrowing area of one of the first common liquid chambers; a plurality of fourth dummy common liquid chambers each of which is adjacent, in the first direction, to the narrowing area of one of the second common liquid chambers; wherein: a sum of a length, of each of the third dummy common liquid chambers, in the second direction and a length, of the narrowing area of each of the first common liquid chambers, in the second direction, may be substantially same as the length in the second direction of the constant-width area of each of the first common liquid chambers; and a sum of a length, of each of the fourth dummy common liquid chambers, in the second direction and a length, of the narrowing area of each of the second common liquid chambers, in the second direction, may be substantially same as the length in the second direction of the constant-width area of each of the second common liquid chambers. In this case, since the third dummy common liquid chamber is formed, it is possible to make a pressure chamber, which is included in the pressure chambers communicating with the first common liquid chambers respectively and which is located in the vicinity of the narrowing area, to have a rigidity close to that of another pressure chamber located in the vicinity of the constant-width area, thereby making the liquid-droplet jetting characteristics to be uniform among the jetting ports communicating with the first liquid common chambers, respectively. In addition, since the fourth dummy common liquid chamber is formed, it is possible to make a pressure chamber, which is included in the pressure chambers communicating with the second common liquid chambers respectively and which is located in the vicinity of the narrowing area, to have a rigidity close to that of another pressure chamber located in the vicinity of the constant-width area, thereby making the liquid-droplet jetting characteristics to be uniform among the jetting ports communicating with the second liquid common chambers, respectively.

According to a second aspect of the present invention, there is provided a liquid-droplet jetting apparatus which has a body and which jets liquid droplets of a liquid, the apparatus including: a plurality of first pressure chambers; a first pressure-chamber row in which the first pressure chambers are arranged in a first direction; a plurality of second pressure chambers; a second pressure-chamber row in which the second pressure chambers are arranged in the first direction; a first common liquid chamber which extends in the first direction and which communicates with each of the first pressure chambers; a second common liquid chambers which extends in the first direction and which communicates with each of the second pressure chambers; and a damper which extends in the first direction and which is located between the first and second common liquid chambers in a thickness direction of the body; wherein each of the first pressure chambers and each of the second pressure chambers extends in a second direction orthogonal to the first direction; the first common liquid chamber has a width in the second direction so as to overlap with the second common liquid chamber in the thickness direction; the damper has a width in the second direction so as to overlap with each of the first and second common liquid chambers in the thickness direction; and each of the first common liquid chamber, the second common liquid chamber and the damper has the width in the second direction which is greater than a length, of one of the first pressure chambers, in the second direction and which is greater than a length, of one of the second pressure chambers, in the second direction.

According to the liquid-droplet jetting apparatus of the present invention, the second common liquid chamber is formed such that the second common liquid chamber overlaps at least partially with the first common liquid chamber in the thickness direction of the body, it is possible to increase a length, of each of the first and second common liquid chambers, in the second direction. Accordingly, it is also possible to increase the length, in the second direction, of the damper formed in a portion at which the first and second common liquid chambers are overlapped. Further, each of the first common liquid chamber, the second common liquid chamber and the damper has the width which is greater than a length of one of the first pressure chambers and is greater than a length of one of the second pressure chambers. Accordingly, it is possible to secure a sufficiently great width for the first and second common liquid chamber and the damper, and to substantially increase acoustic capacitance in the first and second common liquid chambers, thereby making it possible to efficiently attenuate the pressure wave in the first and second common liquid chambers.

In the liquid-droplet jetting apparatus of the present invention, the width in the second direction of each of the first common liquid chamber, the second common liquid chamber and the damper may be substantially same as a sum of the length in the second direction of one of the first pressure chambers and the length in the second direction of one of the second pressure chambers; and the damper may have the width in the second direction so that the damper overlaps in the thickness direction substantially entirely with a portion in which the first and second common liquid chambers are overlapped in the thickness direction. In this case, it is possible to secure a sufficiently great width for each of the first and second common liquid chambers and the damper, and to substantially increase acoustic capacitance in the first and second common liquid chambers, thereby making it possible to efficiently attenuate the pressure wave in the first and second common liquid chambers.

In the liquid-droplet jetting apparatus of the present invention, the damper may communicate with outside air via an air hole. In this case, it is possible to prevent the damage of the liquid-droplet jetting apparatus which would be otherwise caused by the thermal expansion of air in the damper due to heating during the production process.

In the liquid-droplet jetting apparatus of the present invention, the first common liquid chamber may be formed as a plurality of first common liquid chambers arranged in the second direction; the second common liquid chamber may be formed as a plurality of second common liquid chambers arranged in the second direction; the damper may be formed as a plurality of dampers which extend in the first direction and each of which is located, in the thickness direction of the body, between one of the first common liquid chambers and one of the second common liquid chambers. According to this construction, since the first common liquid chambers are formed at a same position in the thickness direction of the body, the rigidity is made to be uniform at portions around the first common liquid chambers, respectively. Therefore, the liquid-droplet jetting characteristics are made to be uniform among the jetting ports communicating with the first common liquid chambers, respectively. In a same manner, since the second common liquid chambers are formed at a same position in the thickness direction of the body, the rigidity is made to be uniform at portions around the second common liquid chambers, respectively. Therefore, the liquid-droplet jetting characteristics are made to be uniform among the jetting ports communicating with the second common liquid chambers, respectively.

In the liquid-droplet jetting apparatus of the present invention, the dampers may communicate with outside air via an air hole. In this case, it is possible to prevent the damage of the liquid-droplet jetting apparatus which would be otherwise caused by the thermal expansion of air in the dampers due to heating during the production process.

BRIEF DESCRIPTION OF THE DRAWINGS

FIGS. 4A to 4C are each a partially enlarged view of the ink-jet head in FIG. 3, wherein FIG. 4A is an enlarged view of the central portion of the ink-jet head, FIG. 4B is an enlarged view of the left end portion of the ink-jet head, and FIG. 4C is an enlarged view of the right end portion of the ink-jet head;

FIGS. 8A to 8C are plan views in which FIG. 8A shows a state in which the first common liquid chambers are projected in the thickness directions of the body, FIG. 8B shows a state in which the second common liquid chambers are projected in the thickness directions of the body, and FIG. 8C shows a state in which the integrated damper chambers are projected in the thickness directions of the body.

DETAILED DESCRIPTION OF THE PREFERRED EMBODIMENTS

The present invention will be explained as follows with respect to a preferred embodiment thereof, with reference to the drawings. This embodiment is an example in which the present invention is applied to an ink-jet head which jets an ink from nozzles.

Figure 1:
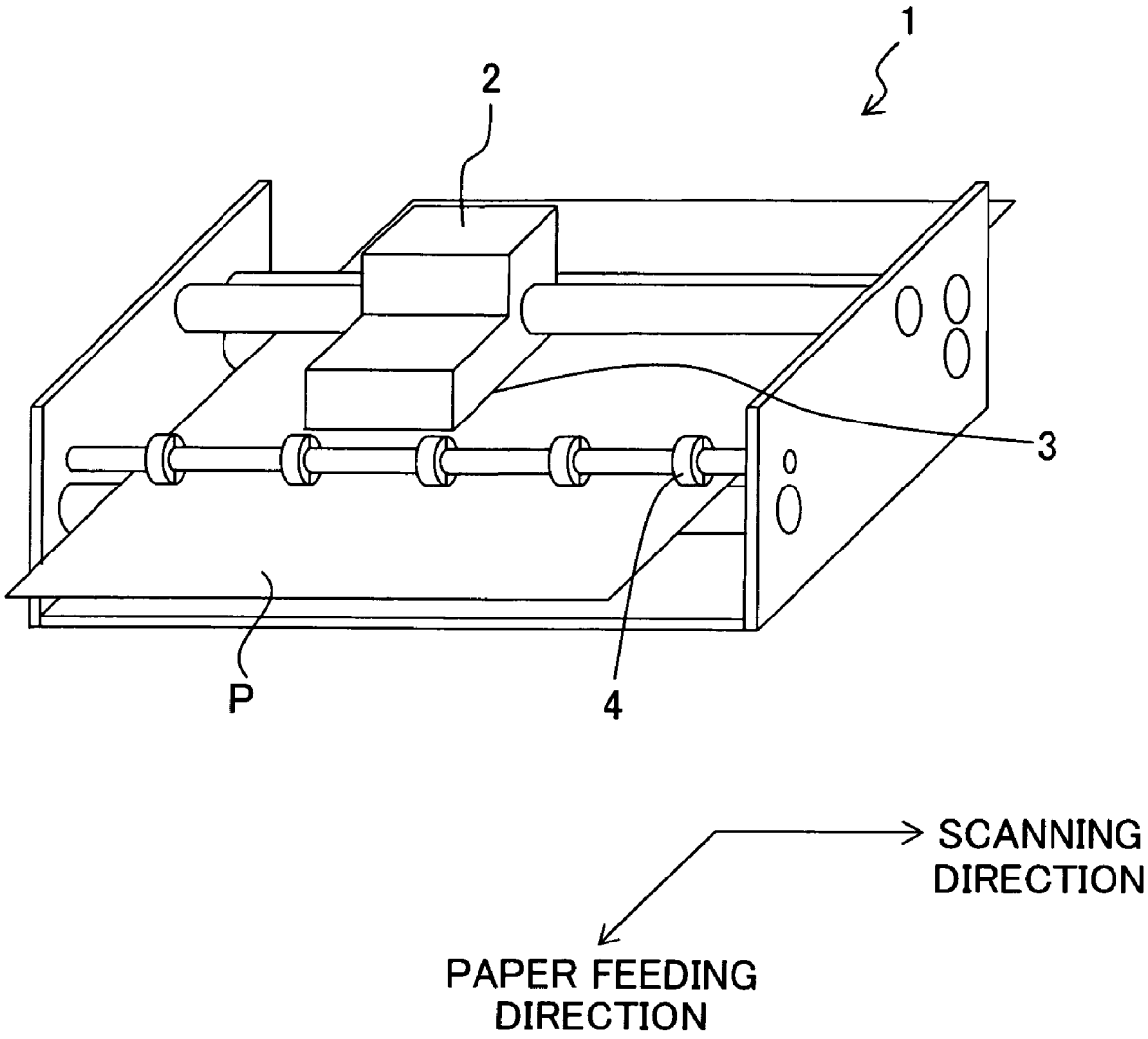
FIG. 1 is a schematic perspective view showing an ink-jet printer according to an embodiment of the present invention.

FIG. 1 is a schematic perspective view of an ink-jet printer 1 according to the embodiment of the present invention. As shown in FIG. 1, the ink-jet printer 1 includes a carriage 2 which is movable in a scanning direction (left and right direction in FIG. 1: second direction); the ink-jet head (liquid-droplet jetting apparatus) 3 of serial type which is constructed to be movable together with the carriage 2 and which jets ink onto a recording paper P; transporting rollers 4 which feed or transport the recording paper P in a paper feeding direction (forward direction in FIG. 1: first direction); and the like. The ink-jet head 3 is constructed to move integrally with the carriage 2 in the scanning direction and to perform printing by jetting ink, onto the recording paper P, from jetting ports of nozzles 16 (see FIG. 3) formed on the lower surface of the ink-jet head 3. The recording paper P, for which printing has been performed thereon by the ink-jet head 3, is discharged in the paper feeding direction by the transporting rollers 4.

Figure 2:
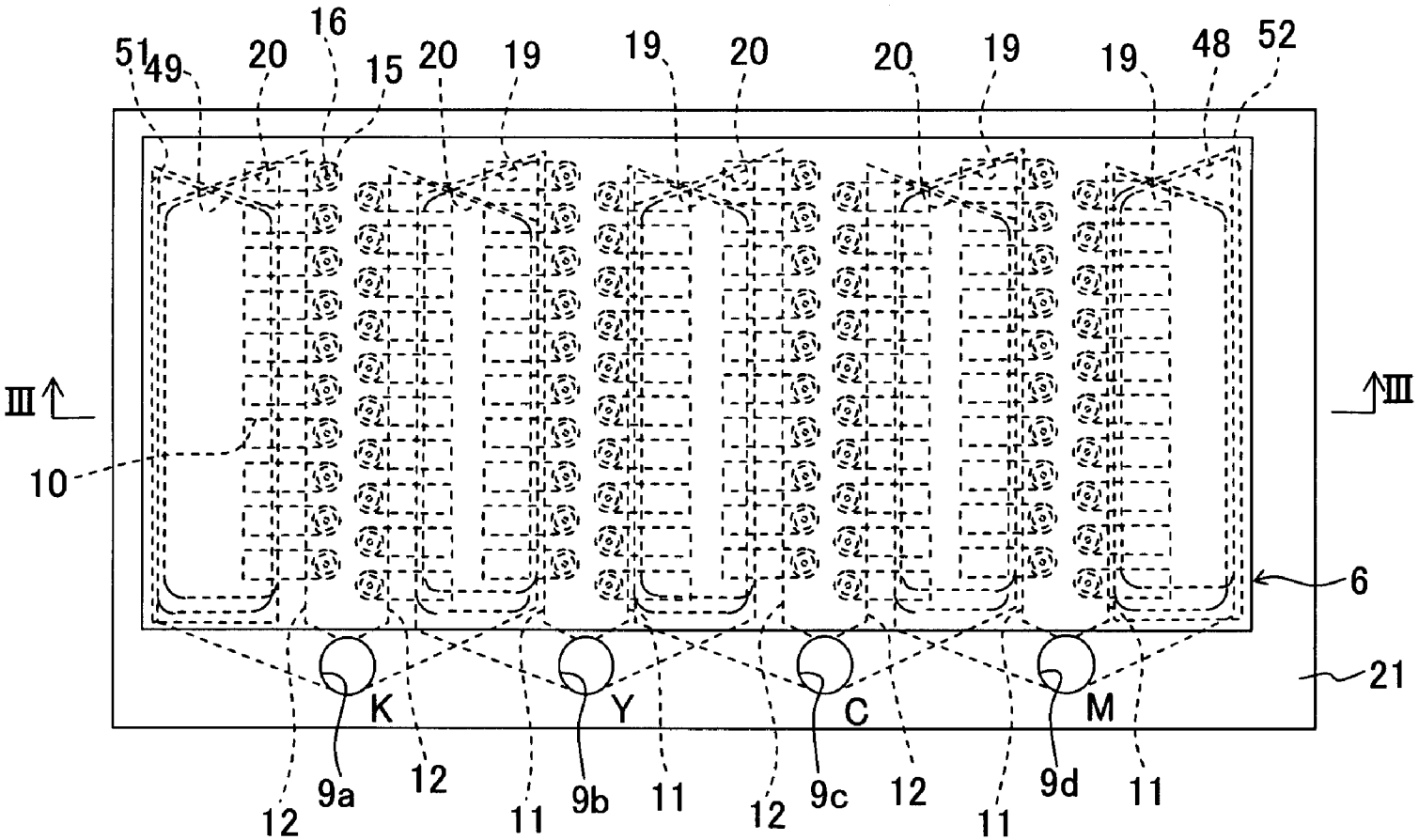
FIG. 2 is a plan view of the ink-jet head in FIG. 1.
Figure 3:
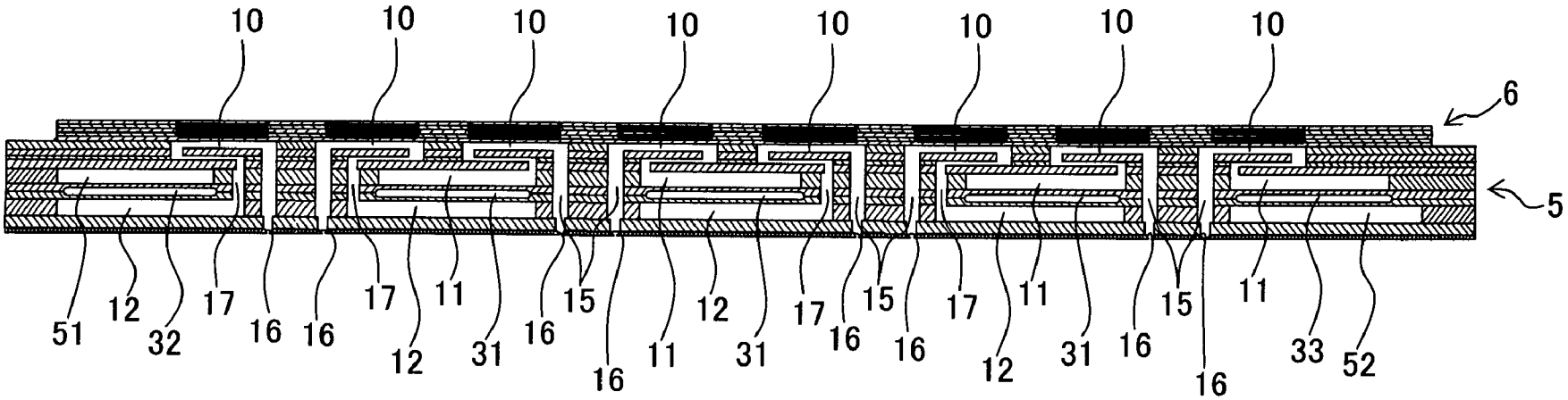
FIG. 3 is a sectional view taken along a line III-III in FIG. 2.
Figure 4A:
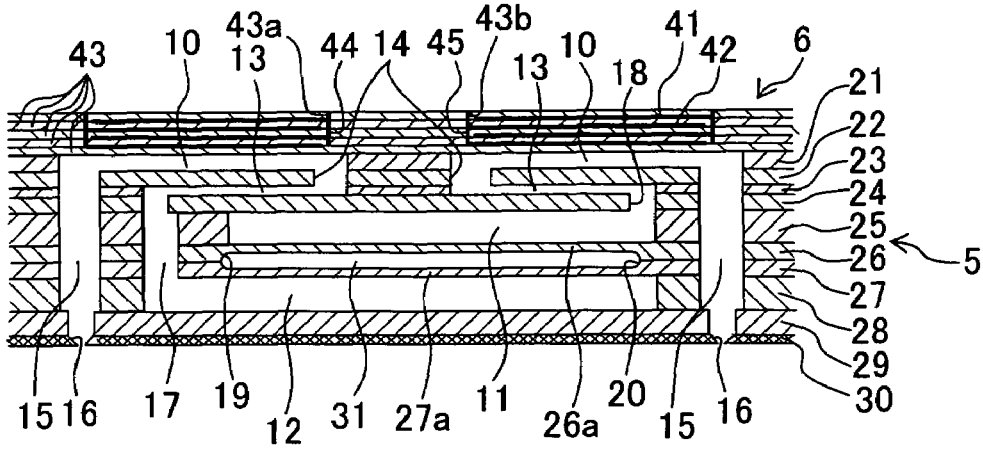
Figure 4B:
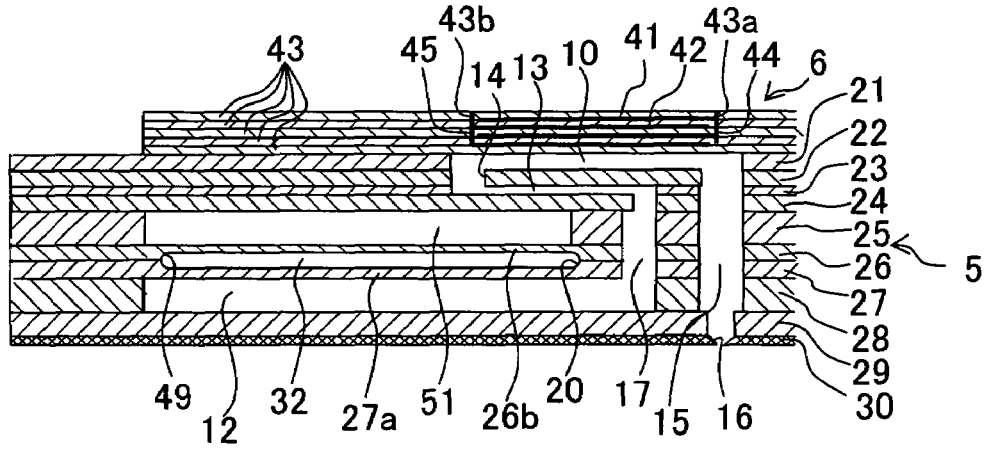
Figure 4C:
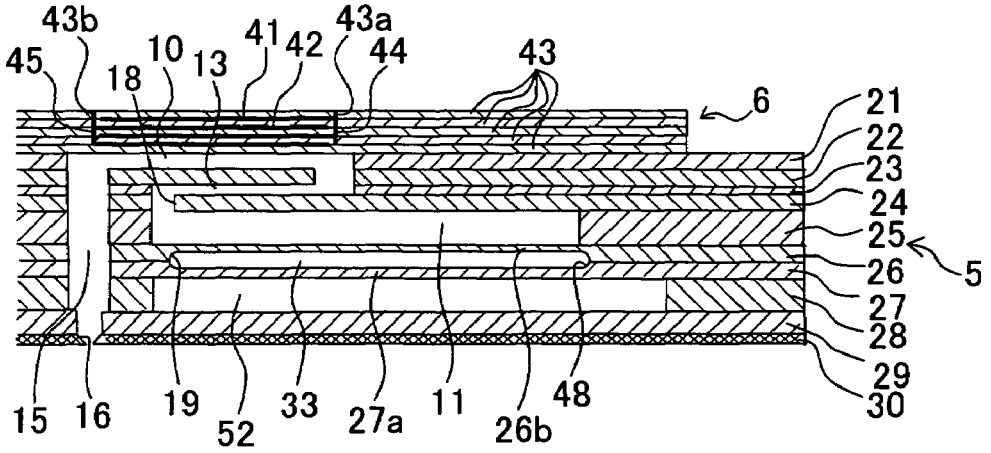

Next, the ink-jet head 3 will be explained with reference to FIGS. 2 to 5. FIG. 2 is a plan view of the ink-jet head 3 in FIG. 1; FIG. 3 is a sectional view taken along line III-III in FIG. 2; FIGS. 4A to 4C are each a partially enlarged view of the ink-jet head in FIG. 3, wherein FIG. 4A is an enlarged view of the central portion of the ink-jet head in FIG. 3, FIG. 4B is an enlarged view of the left end portion of the ink-jet head in FIG. 3, and FIG. 4C is an enlarged view of the right end portion of the ink-jet head in FIG. 3; and FIGS. 5A to 5D are plan views showing a manifold plate 25, a damper plate 26, a damper plate 27 and a manifold plate 28, which construct the ink-jet head 3, respectively.

As shown in FIGS. 2 to 4C, the ink-jet head 3 includes a channel unit 5 in which a plurality of individual ink channels are formed, the individual ink channels being from manifold channels 11 or 12 and reaching to nozzles 16 via pressure chambers 10, respectively; and a piezoelectric actuator (energy applying mechanism) 6 which is arranged on the upper surface of the channel unit 5 to apply pressure to the ink in the pressure chambers 10.

The channel unit 5 includes a cavity plate 21, a base plate 22, an aperture plate 23, a supply plate 24, a manifold plate 25, a manifold plate 28, a damper plate (first flat plate) 26, a damper plate (second flat plate) 27, a cover plate 29 and a nozzle plate 30; and these ten plates 21 to 30 are joined and stacked as laminated layers. Among these ten plates, the nine plates 21 to 29, except for the nozzle plate 30, are formed of a metallic material such as stainless steel. In the plates 21 to 29, the ink channels such as pressure chambers 10, manifold channels 11 and 12, and the like are formed by a method like etching. The nozzle plate 30 is formed of a synthetic resin material such as polyimide, and is bonded to the lower surface of the cover plate 29. As shown in FIG. 2, in the nozzle plate 30, a plurality of nozzles 16 which correspond to the pressure chambers 10 one by one, are formed in eight rows in a paper feeding direction (up and down direction in FIG. 2), by a laser processing (to be described later on). Alternatively, this nozzle plate 30 may be formed also of a metallic material similar to the nine plates 21 to 29. In this case, it is thus possible to prevent any warpage of the channel unit 5 which would be otherwise caused due to difference in linear expansion coefficient among the plates, and to prevent any deviation in positioning between the channels formed in the plates 21 to 29 and the nozzles 16.

As shown in FIGS. 2 to 4C, in the cavity plate 21, a plurality of pressure chambers 10 are formed and aligned in eight rows in the paper feeding direction (up and down direction in FIG. 2: first direction). Each of the pressure chambers 10 is formed to have a substantially rectangular shape which is long in the scanning direction (left and right direction in FIG. 2: second direction). More specifically, the pressure chambers (first pressure chambers) 10 communicating with a manifold channel 11 (first common liquid chamber, to be explained later) and extending in the second direction form a plurality of first pressure-chamber rows aligned in the first direction; and the pressure chambers (second pressure chambers) 10, communicating with a manifold channel (second common liquid chamber, to be explained later) 12 and extending in the second direction adjacently to the longitudinal direction of the pressure chambers (first pressure chambers) 10, form a plurality of second pressure-chamber rows aligned in the first direction. The first and second pressure-chamber rows are arranged in the second direction. In the embodiment, eight pressure-chamber rows are formed.

A plurality of communication holes 14 are formed in the base plate 22 at positions each overlapping in a plane view with a portion in the vicinity of one end portion in the longitudinal direction of one of the pressure chambers 10. The communication holes 14 communicate the pressure chambers 10 and apertures 13 (to be described later), respectively. In addition, a plurality of communication holes are formed in the base plate 22 at positions each overlapping in a plane view with a portion in the vicinity of the other end portion in the longitudinal direction of one of the pressure chambers 10. Each of the communication holes constructs a part of one of the channels 15 communicating the pressure chambers 10 and the nozzles 16, respectively.

A plurality of apertures 13 each of which extends in the longitudinal direction of one of the pressure chambers 10 and which communicate the pressure chambers 10 with the manifold channels 11 or 12, respectively, are formed in the aperture plate 23. In addition, a plurality of communication holes each of which constructs a part of one of the channels 15 are formed in the aperture plate 23. Each of the apertures 13 has a portion in which a sectional channel area thereof is decreased or small between one of the pressure chambers 10 and the manifold channel 11 or 12, so as to adjust an amount of the ink flowing into the pressure chamber 10 from the manifold 11 or 12. Each of the apertures 13 prevents the ink from flowing back from one of the pressure chambers 10 to the manifold channel 11 or 12, thereby suppressing the pressure wave generated in the pressure chamber 10 from propagating to the manifold channel 11 or 12.

A plurality of communication holes each of which constructs a part of the channels 15, a plurality of communication holes which construct a part of channels 17 communicating the apertures 13 and the manifold channels 12, respectively, and a plurality of communication hole 18 which communicate the apertures 13 and the manifold channels 11, respectively, are formed in the supply plate 24.

Figure 5A:
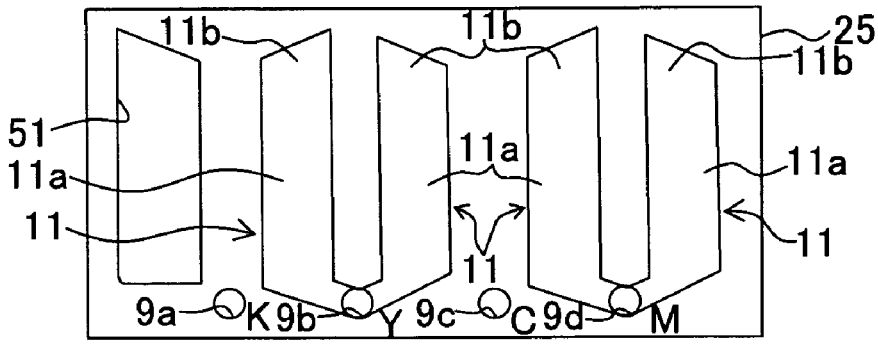
FIGS. 5A and 5D are plan views showing two manifold plates in FIG. 3, respectively.

In the manifold plate 25, four manifold channels (first common liquid chambers) 11 extending in the paper feeding direction (first direction) and communicating with the pressure chambers (first pressure chambers) 10 are formed to align in the scanning direction (second direction). The ink is supplied from an ink inlet port 9*b* to two manifold channels 11, among the four manifold channels 11 and disposed on the left side in FIG. 2; and ink is supplied from an ink inlet port 9*d* to two manifold channels 11 disposed on the right side in FIG. 2. As shown in FIG. 5A, each of the manifold channels 11 has a constant-width area 11*a* which extends in an up and down direction in FIG. 5A and with a substantially constant width (length in left and right direction in FIG. 5A); and a narrowing area 11*b* which continued to the constant-width area 11*a* at an end, of the narrowing area 11*b*, opposite to the ink inlet port 9*b* or 9*d* and in which a width thereof is narrowed in a direction away from the ink inlet port 9*b* or 9*d* (toward upper portion in FIG. 5A). Namely, when a virtual plane is considered which is parallel to the cavity plate 21 and which includes the manifold plate 25 (manifold channels 11), then in this virtual plane, each of the manifold channels 11 is constructed of a constant-width area 11*a* in which a length in a direction orthogonal to the paper feeding direction is substantially constant, and a narrowing area 11*b* which is formed in the manifold channel 11 at an end portion in the downstream in the paper feeding direction to have a shape being narrowed toward the downstream end portion thereof. The constant-width area 11*a* and the narrowing area 11*b* are smoothly connected. Accordingly, the ink flowed from the ink inlet port 9*b* and 9*d* flows assuredly and entirely in the manifold channels 11 respectively. Note that the manifold channels 11 supply the ink to the pressure chambers 10 belonging to the third, fourth, seventh and eighth rows from the left in FIG. 2.

Figure 8A:
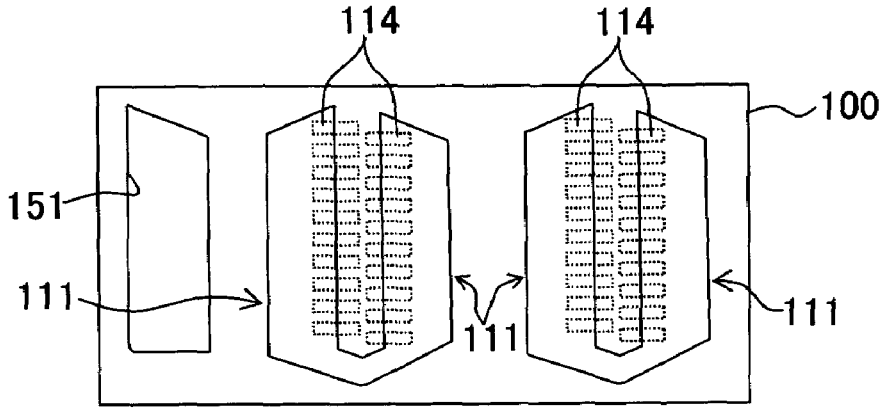
Figure 8B:
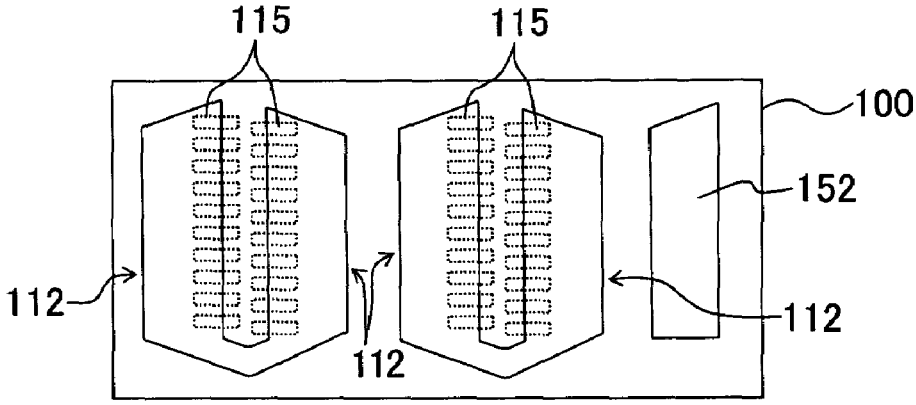

Further, a dummy manifold channel (first dummy common liquid chamber) 51 is formed in the manifold plate 25 at an area overlapping with a manifold channel (second common liquid chamber) 12 which is included in four manifold channels (second common liquid chambers, to be explained later) 12, and which is disposed at the leftmost position shown in FIG. 2. The dummy manifold channel 51 extends in the up and down direction in FIG. 5A, has a width same as that of the constant-width area 11*a* in one of the manifold channels 11, and has an end portion at the upper side in FIG. 5A of which shape is substantially same as that of the narrowing area 11*b*. Namely, as shown in FIGS. 8A and 8B, among four areas (second areas) 112 formed by projecting the four manifold channels (the second common liquid chambers) 12 onto a virtual first plane 100 which is parallel to the cavity plate 21, the leftmost area partially overlaps only with an area 151 formed by projecting the dummy manifold channel 51 to the first plane. In such a manner, in the manifold plate 25, one dummy manifold channel 51 through which no ink flows, and four manifold channels 11 through which the ink flows are formed as through holes in this order from the left to right in FIG. 2. Each of the through holes has an overlapping portion which overlaps, in a direction in which the plates constructing the channel unit 5 are stacked (thickness direction of the body), with a damper portion (damper chamber and thin-walled portion) of the damper plate 26 (which will be described later on). Furthermore, a plurality of communication holes, each of which constructs a part of the channels 15, and a plurality of communication holes, each of which constructs a part of the channels 17, are formed in the manifold plate 25.

Figure 5B:
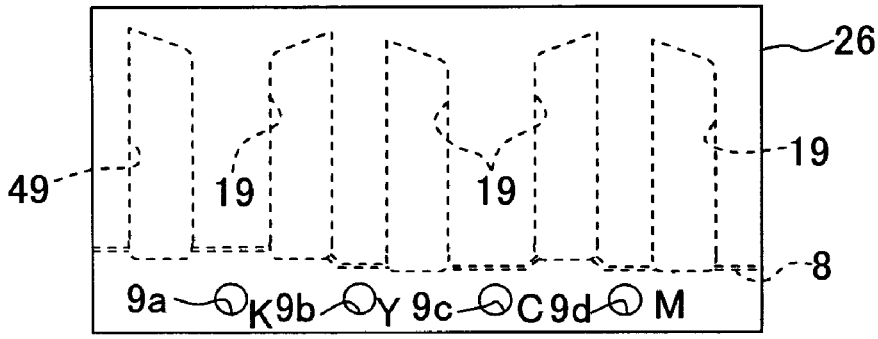
FIGS. 5B and 5C are plan views showing two damper plates in FIG. 3, respectively.

In the damper plate (first plate) 26, a plurality of recesses (first damper chambers, first recessed portions) 19 are formed on the lower surface thereof at portions overlapping in a plan view with the manifold channels 11, respectively; and a recess (first dummy damper chamber, first dummy recessed portion) 49 is formed on the lower surface of the damper plate 26 at a portion overlapping in a plan view with the dummy manifold channel 51. As shown in FIGS. 4A and 4C, the portions in the damper plate 26 at which the recesses 19 are formed and consequently with decreased thickness are thin-walled portions (first thin-walled portions) 26*a*. Further, as shown in FIG. 4B, the portion in the damper plate 26 at which the recess 49 is formed and consequently with decreased thickness is a thin-walled portion (first dummy thin-walled portion) 26*b*. As shown in FIG. 5B, the recesses 19 have a substantially same shape and size as those of the manifold channels 11, respectively, which are located above the recesses 19; and the recess 49 has a substantially same shape and size as those of the dummy manifold channel 51 located above the recess 49. Each of the thin-walled portions 26*a* defines a lower wall surface of one of the manifold channels 11, and is deformed to thereby attenuate pressure wave in the manifold channel 11. Further, as shown in FIG. 5B, an air hole 8 is formed in the damper plate 26. The air hole 8 communicates the recesses 19 and the recess 49 with one another and is communicated to the outside air at side surfaces of the damper plate 26. Furthermore, a plurality of communication holes forming a part of the channels 15 and 17, respectively, are also formed in the damper plate 26.

Figure 5C:
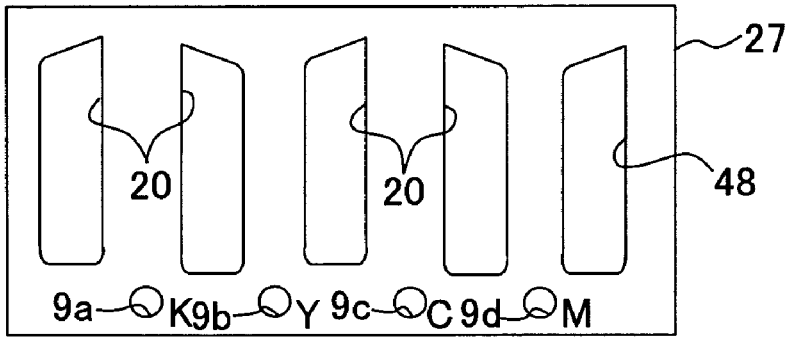

In the damper plate (second plate) 27, recesses (second damper chambers, second recessed portions) 20 are formed on the upper surface thereof at portions overlapping in a plan view with the manifold channels 12, respectively; and a recess (second dummy damper chamber, second dummy recessed portion) 48 is formed on the upper surface of the damper plate 27 at a portion overlapping in a plan view with a dummy manifold channel 52 (to be described later on). As shown in FIGS. 4A and 4B, the portions in the damper plate 27 at which the recesses 20 are formed and consequently with decreased thickness are thin-walled portions (second thin-walled portions) 27*a*. Further, as shown in FIG. 4C, the portion in the damper plate 27 at which the recess 48 is formed and consequently with decreased thickness is a thin-walled portion (second dummy thin-walled portion) 27*b*. As shown in FIG. 5C, the recesses 20 have a substantially same shape and size as those of the manifold channels 12, respectively, which are located below the recesses 20; and the recess 48 has a substantially same shape and size as those of the dummy manifold channel 52 located below the recess 48. Each of the thin-walled portions 27*a* defines an upper wall surface of one of the manifold channels 12, and is deformed to thereby attenuate pressure wave in the manifold channel 12. Further, a plurality of communication holes forming a part of the channels 15 and 17, respectively, are also formed in the damper plate 27.

By staking the damper plates 26 and 27 in a laminated form, openings of the recesses formed in each of the damper plates 26 and 27 are closed by one another, thereby integrating the damper portions (damper chambers and the thin-walled portions) formed in the plates, respectively. Spaces are formed between the recesses 19 and 20, between the recesses 20 and 49, and between the recesses 19 and 48; and these spaces are communicated with one another and with the outside air via the air hole 8. Here, a plurality of spaces 31 defined by the recesses 19 and 20, respectively, are a plurality of integrated damper chambers integrating the first and second damper chambers according to the present invention; a space 32 defined by the recesses 49 and 20 is an integrated damper chamber integrating the first dummy damper chamber and the second damper chamber according to the present invention; and a space 33 defined by the recesses 48 and 19 is an integrated damper chamber integrating the second dummy damper chamber and the first damper chamber according to the present invention. Namely, the integrated damper chambers (dampers) extend in the first direction, and are located, in the thickness direction of the body, between the plurality of manifold channels 11 and a plurality of manifold channels 12, respectively. The manifold channels 12 will be described later on.

Four manifold channels (second common liquid chambers) 12 extending in the paper feeding direction (first direction) and communicating with the pressure chambers (second pressure chambers) 10 respectively are formed to be aligned in the scanning direction (second direction) in the manifold plate 28. Here, three manifold channels 12 from the right, among the four manifold channels 12 in FIG. 2, are formed at positions each overlapping with one of three manifolds 11 from the left, among the four manifold channels 11 in FIG. 2. Among the four manifold channels 12, regarding two manifold channels 12 located at the left portion in FIG. 5D, the ink is supplied thereto from an ink inlet port 9*a*; and regarding two manifold channels 12 located at the right portion in FIG. 5D, the ink is supplied thereto from an ink inlet port 9*c*. Each of the manifold channels 12 has a constant-width area 12*a* which extends in an up and down direction in FIG. 5D and with a substantially constant width; and a narrowing area 12*b* which continues to the constant-width area 12*a* formed at an upper end of the narrowing area 12*b* in FIG. 5D, and in which a width is narrowed in a direction away from the ink inlet port 9*a* or 9*c* (toward upper portion in FIG. 5D). Namely, when a virtual plane is considered which is parallel to the cavity plate 21 and which includes the manifold plate 28 (manifold channels 12), then in this virtual plane, each of the manifold channels 12 is constructed of a constant-width area 12*a* in which a length in the direction orthogonal to the paper feeding direction is substantially constant, and a narrowing area 12*b* which is formed in the manifold channel 12 at an end portion in the downstream in the paper feeding direction to have a shape being narrowed toward the downstream end portion thereof. The constant-width area 12*a* and the narrowing area 12*b* are smoothly connected. Accordingly, the inks flowed from the ink inlet port 9*a* and 9*c* flows assuredly and entirely in the manifold channels 12, respectively. Note that the manifold channels 12 supply the ink to the pressure chambers 10 belonging to the first, second, fifth and sixth rows from the left in FIG. 2.

Figure 8C:
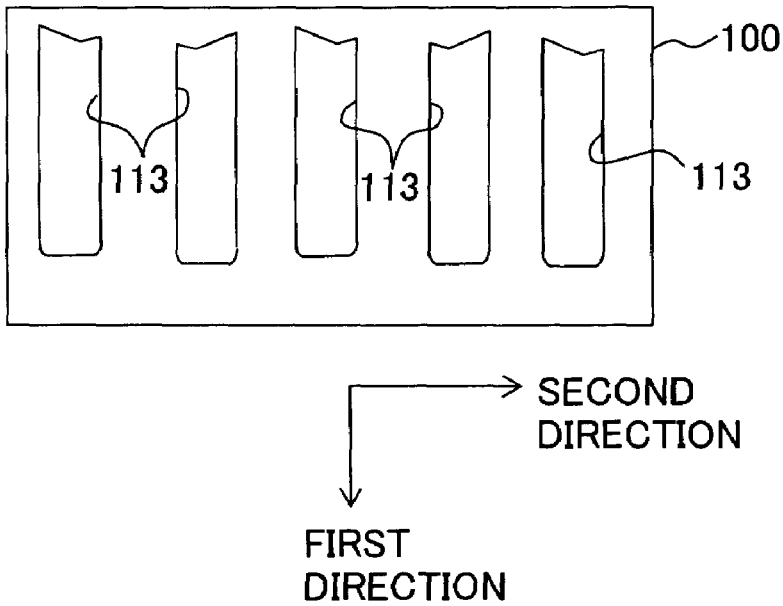

Further, a dummy manifold channel (second dummy common liquid chamber) 52 is formed in the manifold plate 28 at an area overlapping with a manifold channel (first common liquid chamber) 11 which is included in four manifold channel (first common liquid chambers) 11 and is disposed at the rightmost position in FIG. 2. The dummy manifold channel 52 extends in the up and down direction in FIG. 5D, has a width same as that of the constant-width area 12*a* in one of the manifold channels 12, and has an end portion at the upper side in FIG. 5D of which shape is substantially same as that of the narrowing area 12*b*. Namely, as shown in FIGS. 8A and 8B, among four areas (first areas) 111 formed by projecting the four manifold channels (the first common liquid chambers) 11 onto the first plane 100, the rightmost area partially overlaps only with an area 152 formed by projecting the dummy manifold channel 52 to the first plane 100. In such a manner, in the manifold plate 28, one dummy manifold channel 52 through which no ink flows, and four manifold channels 12 through which the ink flows are formed as through holes in this order from the right to left in FIG. 2. Each of the through holes has an overlapping portion which overlaps, in the stacking direction of the plates constructing the channel unit 5, with a damper portion (damper chamber and thin-walled portion) of the damper plate 26 (described as above). Namely, as shown in FIGS. 8A to 8C, a plurality of third areas 113 formed by projecting the integrated damper chambers in the stacking direction onto the first plane 100, respectively, each overlaps at least partially with an area in which one of the first areas 111 formed by projecting the manifold channels (first common liquid chambers) 11 in the stacking direction onto the first plane 100 and one of the second areas 112 formed by projecting the manifold channels (second common liquid chambers) 12 in the stacking direction onto the first plane 100 are overlapped. Furthermore, a plurality of communication holes, each of which constructs a part of the channels 15, are formed in the manifold plate 28.

Figure 5D:
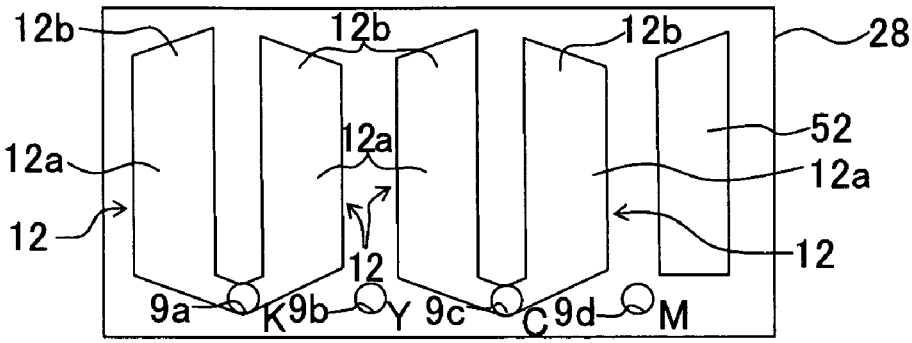

Here, since the dummy manifolds 51, 52 and the recesses 48, 49 are formed, the rigidity of the channel unit 5 in portions at the both left and right ends thereof is made to be similar to that at an inner portion thereof, thereby uniforminizing the jetting characteristics among a plurality of nozzles 16 (to be described later). Namely, as shown in FIG. 5A, the dummy manifold 51 is located at the leftmost position in a manifold-channel row constructed of the manifold channels 11 and the dummy manifold 51. Further, as shown in FIG. 5D, the dummy manifold 52 is located at the rightmost position in a manifold-channel row constructed of the manifold channels 12 and the dummy manifold 52. As shown in FIGS. 2 and 4B, the manifold channel 12 which overlaps with the dummy manifold 51 is communicated with pressure chambers 10 belonging to a pressure-chamber row and extending in the cavity plate 21 toward pressure-chambers 10 belonging to another pressure-chamber row adjacent to the pressure-chamber row (extending in the rightward direction in FIG. 2). Further, as shown in FIGS. 2 and 4C, the manifold channel 11 which overlaps with the dummy manifold 52 is communicated with pressure chambers 10 belonging to a pressure-chamber row and extending in the cavity plate 21 toward pressure-chambers 10 belonging to another pressure-chamber row adjacent to the pressure-chamber row (extending in the leftward direction in FIG. 2). As viewed from a direction in which the plates 21 to 30 are stacked, each of the pressure chambers 10 has an end to which the ink is supplied and which overlaps with the two manifold channels and two damper portions, regardless of the location at which the pressure chamber is arranged. On the other hand, each of the pressure chambers 10 communicates with one of the nozzles 16 at the other end thereof; and the other end of a certain pressure 10 belonging to one of the pressure chamber rows faces the other end of another pressure chamber 10 belonging to another pressure chamber row adjacent to the pressure chamber row to which the certain pressure chamber 10 belongs. In this embodiment, the nozzles 16, which belong to adjacent nozzle rows respectively, form a staggered or zigzag arrangement as shown in FIG. 2. Corresponding to this, in each of the individual ink channels each from one of the two manifold channels commonly having one ink inlet port and reaching to one of the nozzles 16 via one of the pressure chambers 10, the communication holes each from one of the pressure chambers 10 and reaching to one of the nozzles 16 also form a zigzag arrangement. As described above, the pressure chambers 10 have a similar three-dimensional structure in the channel unit 5, and thus the portions, in the channel unit 5, surrounding the pressure chambers 10 respectively are constructed to have a rigidity substantially same among themselves. Here, the term "jetting characteristic of the ink" means the droplet speed of the ink droplet jetted from the nozzles 16, the volume of the ink droplet jetted from the nozzles 16, and/or the like.

A plurality of communication holes each constructing a part of one of the channels 15 are formed in the cover plate 29. The plurality of nozzles 16 are formed in the nozzle plate 30 at positions each overlapping in a plan view with one of the channels 15. In other words, the nozzles 16 are arranged in eight rows in the up and down direction in FIG. 2, and the jetting ports of the nozzles 16 are formed in the lower surface of the nozzle plate 30. When the nozzle plate 30 is formed of a synthetic resin material, the nozzles 16 can be formed by eximer-laser processing or the like. Alternatively, when the nozzle plate 30 is formed of a metallic material, the nozzles 16 can be formed by press processing or the like. In this embodiment, the above-described ink inlet ports 9*a* to 9*d* supply black (K), yellow (Y), cyan (c) and magenta (M) inks, respectively. The black ink is jetted from the nozzles 16 formed in the first and second nozzle rows from the left in FIG. 2; the yellow ink is jetted from the nozzles 16 formed in the third and fourth nozzle rows from the left in FIG. 2; the cyan ink is jetted from the nozzles 16 formed in the fifth and sixth nozzle rows from the left in FIG. 2; and the magenta ink is jetted from the nozzles 16 formed in the seventh and eighth nozzle rows from the left in FIG. 2.

As described above, each of the manifold channels (second common liquid channels) 12 communicates with the pressure chambers (second pressure chambers) 10 via the channels 17, the apertures 13 and the communication holes 14, respectively; and each of the pressure chambers 10 in the manifold channel 12 communicates, via one of the channels 15, with a jetting port (second jetting port) of one of the nozzles 16 formed in one of the first, second, fifth and sixth nozzle rows from the left in FIG. 2. On the other hand, each of the manifold channels (first common liquid chambers) 11 communicates with the pressure chambers (first pressure chambers) 10 via the communication holes 18, the apertures 13 and the communication holes 14, respectively; and each of the pressure chambers 10 in the manifold channel 11 communicates via one of the channels 15 with a jetting port (first jetting port) of one of the nozzles 16 formed in one of the third, fourth, seventh and eighth nozzle rows from the left in FIG. 2. In such a manner, the channel unit 5 is provided with a plurality of first individual ink channels (first individual liquid channels) which is formed in the channel unit 5 and each of which is from an outlet port (connection port) of one of the manifold channels 11 and arriving at one of the nozzles 16 via one of the pressure chambers 10; and a plurality of second individual ink channels (second individual liquid channels) which is formed in the channel unit 5 and each of which is from an outlet port (connection port) of one of the manifold channels 12 and arriving at one of the nozzles 16 via one of the pressure chambers 10.

Here, an explanation will be given about the size in the second direction of and the relative positions in the second direction among the manifold channels (first common liquid chambers) 11, the manifold channels (second common liquid chambers) 12, the integrated damper chambers (dampers), two pressure chambers (first and second pressure chambers) mutually adjacent in the second direction, as viewed in the stacking direction. First, the manifold channels 11 and the manifold channels 12 have a positional relationship in the second direction in which each of the first areas 111, formed by projecting the manifold channels 11 in the stacking direction onto the first plane 100, partially overlaps with one of the second areas 112 formed by projecting the manifold channels 12 in the stacking direction onto the first plane 100. In other words, the manifold channels 11 have a width in the second direction so that the manifold channels 11 overlap with the manifold channels 12 in the stacking direction. Further, as shown in FIGS. 8A to 8C, the manifold channels 11, the manifold channels 12, and the integrated damper chambers have a positional relationship in the second direction such that overlapping areas, at which the first areas 111 and the second areas 112 overlap respectively, partially overlap with the third areas 113 formed by projecting the integrated damper chambers in the stacking direction onto the first plane 100. In other words, the integrated damper chambers have a width in the second direction so that the integrated damper chambers overlap, in the stacking direction, with the manifolds 11 and the manifolds 12, respectively. More specifically, the third areas 113 have a positional relationship in which the third areas 113 overlap substantially entirely with the overlapping areas in each of which one of the first areas 111 and one of the second areas 112 are overlapped. Furthermore, the first areas 111, the second areas 112, the third areas 113 have a positional relationship in which the first areas 111, the second areas 112, the third areas 113 overlap with both of areas 114 each formed by projecting one of the first pressure chambers in the stacking direction onto the first plane 100 and areas 115 each formed by projecting one of the second pressure chambers in the stacking direction onto the first plane 100. Namely, each of the manifold channels 11, the manifold channels 12 and the integrated damper chambers has a width in the second direction so that each of the manifold channels 11, the manifold channels 12 and the integrated damper chambers overlaps, in the stacking direction, with the one of the first pressure chamber rows and one of the second pressure chamber rows. Further, each of the manifold channels 11, manifold channels 12 and dampers has a width greater than the length of the first pressure chamber 10 and greater than the length of the second pressure chamber 11. Furthermore, each of the manifold channels 11, the manifold channels 12 and the dampers has the width substantially same as a sum of the length of one of the first pressure chambers and the length of one of the second pressure chambers.

A piezoelectric actuator 6 is formed on the upper surface of the channel unit 5. The piezoelectric actuator 6 has five piezoelectric layers 43 stacked on the upper surface of the channel unit 5; and individual electrodes 41 and common electrodes 42 formed alternately between the piezoelectric layers 43.

Among the piezoelectric layers 43, a piezoelectric layer 43 disposed at the lowermost position is arranged on the upper surface of the cavity plate 21 and is jointed to the upper surface so that the lowermost piezoelectric layer 43 covers the pressure chambers 10. As shown in FIG. 2, in the cavity plate 21, the four ink inlet ports 9*a* to 9*d* are formed as a row at the lower end of the cavity plate 21, and the piezoelectric layers 43 are arranged to avoid (not to overlap or interfere with) these ink inlet ports 9*a* to 9*d*. The remaining four piezoelectric layers 43 are staked on the lowermost piezoelectric layer 43. The piezoelectric layers 43 are formed by cutting a piezoelectric sheet (to be described below) into a predetermined size and by arranging the cut piezoelectric sheets on the channel unit 5. The piezoelectric sheet is obtained by calcinating a green sheet of a piezoelectric material mainly composed of a lead zirconate titanate (PZT) that is a solid solution of lead titanate and lead zirconate and is a ferroelectric substance. The individual electrodes 41 and the common electrodes 42 are formed such that the electrodes 41 and 42 are alternately disposed between the stacked piezoelectric layers 43, and that the electrodes 41 and 42 are mutually shifted in a plan view in the left and right direction in FIG. 3 so as not to completely overlap with one another. Further, as shown in FIGS. 4A to 4C, in each of the four piezoelectric layers 43, excluding the lowermost piezoelectric layer 43, a through hole 43*a* is formed at an area which overlaps in a plan view with the individual electrodes 41 and which does not overlap in a plan view with the common electrodes 42; and a through hole 43*b* is formed at an area which overlaps in a plan view with the common electrodes 42 and which does not overlap in a plan view with the individual electrodes 41. Conductive materials 44 and 45 are filled in the through holes 43*a* and 43*b*, respectively.

A Flexible Printed Circuit (FPC, not shown in the drawings) is arranged on the upper surface of the piezoelectric actuator 6. The individual electrodes 41 are connected to a driver IC (not shown in the drawings) via the conductive material 44 and the FPC, and the drive IC controls electric potential of the individual electrodes 41. The common electrodes 42 are connected to the driver IC via the conductive material 45 and the FPC, and are always kept at ground potential by the driver IC.

Next, an explanation will be given about a method for driving the piezoelectric actuator 6. When predetermined voltage is selectively applied from the driver IC to the individual electrodes 41 via the FPC and the conductive material 44, electric potential of the individual electrodes 41, to which the voltage is applied is different from that of the common electrodes 42 kept at the ground potential. At this time, since an electric field is generated in a portion of the piezoelectric layer 43 sandwiched between one of the individual electrodes 41 and one of the common electrodes 42, the piezoelectric layer 43 expands by the vertical piezoelectric effect in a thickness direction thereof in which the piezoelectric layer 43 is polarized. This consequently decreases the volume in pressure chambers 10 corresponding to the individual electrodes 41 applied with the voltage, thereby increasing the pressure of the ink in the pressure chambers 10 so as to jet the ink from nozzles 16 communicating with the pressure chambers 10. The piezoelectric actuator 6 has the five piezoelectric layers 41, and when the actuator 6 is driven, the four piezoelectric layers, excluding the lowermost piezoelectric layer, expand respectively in the thickness direction. Therefore, the deformation amount of the piezoelectric actuator 6 as a whole is great, thereby making it possible to apply a substantial pressure to the ink in the pressure chambers 10 by one drive.

At this time, a pressure wave is generated in the pressure chamber 10 by the increase in pressure in the pressure chamber 10. A part of the pressure wave is propagated from the pressure chamber 10 to the manifold channel 11 or 12. When the pressure wave is propagated to the manifold channel 11, the thin-walled portion 26*a* of the damper plate 26 is deformed to attenuate the pressure wave. On the other hand, when the pressure wave is propagated to the manifold channel 12, the thin-walled portion 27*a* of the damper plate 27 is deformed to attenuate the pressure wave.

Here, the attenuating effect of pressure wave in the manifold channels 11, 12 becomes greater as acoustic capacitance in the manifold channels 11, 12 are greater. The acoustic capacitance of the manifold channel 11, 12 is a sum of Cv and Cd, wherein Cv is an acoustic capacitance determined by the volume of the manifold channel 11, 12 and the elasticity of the ink, and Cd is an acoustic capacitance determined by the elastic deformation of damper. However, since the value of Cv is very smaller than the value of Cd, only the acoustic capacitance Cd is considered here. The acoustic capacitance Cd is represented by an expression $[I_d \cdot W_d^5(1-v_d)]/[6OE_d \cdot t_d^3]$. In the expression, $I_d$ is a length of the thin-walled portion 26*a*, 27*a* in the up and down direction in FIG. 2; $W_d$ is a width (length in the left and right direction in FIG. 2) of the thin-walled portion 26*a*, 27*a*; $t_d$ is a thickness of the thin-walled portion 26*a*, 27*a*; Ed is an elasticity of the thin-walled portion 26*a*, 27*a*; and $v_d$ is a Poisson's ratio of the thin-walled portion 26*a*, 27*a*.

As described above, the acoustic capacitance of the manifold channel 11, 12 is proportional to the fifth power of $W_d$, and is inversely proportional to the third power of $t_d$. In other words, it is possible to effectively increase the acoustic capacitance of the manifold channel 11, 12 by increasing $W_d$ or decreasing $t_d$. In the embodiment of the present invention, since the manifolds 11 and 12 are arranged to overlap in a plan view, the width $W_d$ of each of the thin-walled portions 26*a* and 27*a* can be great by an amount of an area in which the manifold channels 11 and 12 are overlapped. Accordingly, it is possible to make the acoustic capacitance of the manifold channels 11, 12 to be great, thereby effectively attenuating the pressure wave in the manifold channels 11, 12.

According to the embodiment as explained above, since the manifold channels 12 are formed to overlap with the manifold channels 11 in a plan view, the width of the thin-walled portions 26*a*, 27*a* can be greater than a case in which the manifold channels 11, 12 are arranged side by side in a same plane. This in turn makes is possible to increase the acoustic capacitance of the manifold channels 11, 12, thereby effectively attenuating the pressure wave in the manifold channels 11, 12. Accordingly, the pressure wave generated in a certain pressure chamber 10 and propagated to the manifolds 11 and 12 is hardly propagated further to another pressure chamber 10, thereby suppressing the crosstalk.

Further, by forming the recesses 19 and 20 in the damper plates 26 and 27 respectively, the thin-walled portions 26*a* and 27*a* are formed and a space between one of the recesses 19 and one of the recesses 20 forms a damper chamber in which the thin-walled portions 26*a* and 27*a* are deformed. Accordingly, there is no need to form spaces to be the damper chamber and the thin-walled portions 26*a*, 27*a* separately, thereby making it possible to reduce the number of parts.

Furthermore, the jetting ports (first jetting ports, second jetting ports) of the nozzles 16 are all formed in the lower surface of the nozzle plate 30 having a flat shape. In other words, the number of part for forming the jetting ports of the nozzles 16 is only one, and thus the nozzles 16 formed in a same member are processed highly accurately, thereby maintaining the mutual positional relationship highly precisely. This in turn contributes to decreasing the cost for the ink-jet head 3 and uniformizing the ink-jetting characteristics among the nozzles 16.

Moreover, since the pressure chambers 10 communicating with the manifold channels 11 and the pressure chambers 10 communicating with the manifold channels 12 are all formed at same height, with respect to the up and down direction in FIG. 3, it is possible to make the rigidity to be uniform around all the pressure chambers 10, and to arrange the energy applying mechanism on a same plane. Accordingly, it is possible to decrease the number of parts, and to increase the positioning accuracy between the individual electrodes 41 and the pressure chambers 10. This further makes the ink-jetting characteristics to be uniform among the nozzles 16 communicating with the pressure chambers 10.

Further, as shown in FIG. 2, since pressure chambers 10 communicating with nozzles 16 which jet an ink of a same color are communicated only with one of the manifold channels 11 or one of the manifold channels 12. Accordingly, the ink of same color is supplied to the nozzles 16 via the ink channel of a same structure. This makes the ink-jetting characteristic to be uniform among the nozzles 16 which jet the ink of same color.

Note that the manifold channels 11 and 12 are located at positions which are mutually different in the stacking direction of the plates since the manifold channels 11 and 12 are formed to be in an overlapping relationship. Accordingly, there is a difference in a channel length between a channel route from the manifold channel 11 to the pressure chamber 10 and a channel route from the manifold channel 12 to the pressure chamber 10, which causes in some cases a difference in the ink-jetting characteristics between the pressure chambers 10 communicating with the manifold channels 11 and 12, respectively. In this case, it is allowable to consider the pressure chambers 10 communicating with the manifold channel 11 as one group and the pressure chambers 10 communicating with the manifold channel 12 as another group, and to drive these groups as appropriate. Further, in view of realizing high resolution, it is effective to allocate or assign an ink of one color to each of the manifold channels 11 and 12.

Further, sine the dummy manifold channels 51 and 52, and the recesses 49 and 48 are formed, the attenuating characteristics are substantially same in the channel unit 5 at the both left and right end portion and at the central portion in FIG. 2, thereby uniformizing the jetting characteristics of the ink jetted form the nozzles 16.

Furthermore, as shown in FIG. 5B, the spaces defined by the recesses 19 and 20, by the recesses 19 and 48, and by the recesses 20 and 49, respectively, are communicated with the outside air via the air hole 8. Accordingly, it is possible to prevent any unsatisfactory bonding between the damper plates 26 and 27 which would be otherwise caused by the air expansion in these spaces due to the heating in the production process of the channel unit 5, and to further prevent the channel unit 5 from being broken.

Next, modified embodiments in which various changes are made to the embodiment will be explained. Same reference numerals will be given to parts or components having similar construction as those in the embodiment, and explanation therefor will be omitted as appropriate.

Figure 6:
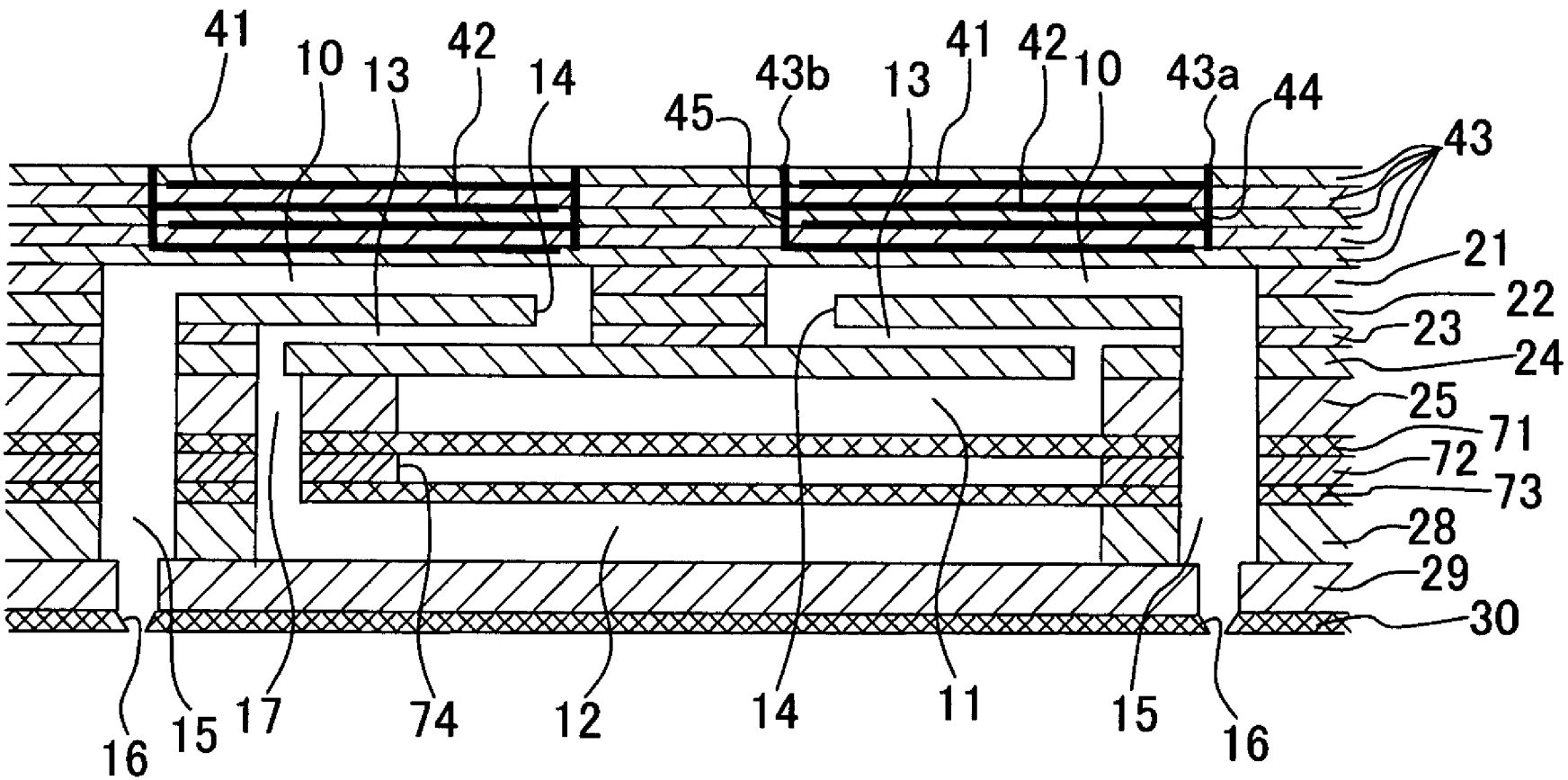
FIG. 6 is a sectional view of a first modification, corresponding to FIG. 4A.

In a first modification, as shown in FIG. 6, two synthetic resin plates 71 and 73 each formed of a synthetic resin material are arranged between the manifold plates 25 and 28. Further, a spacer plate 72, which is arranged between the plates 71 and 73, is provided with through holes 74 formed therein at areas each overlapping in a plan view with the manifold channels 11, 12. In this case also, a portion (first thin-walled portion), of the synthetic resin plate 71, which faces in a plan view with one of the through holes 74 can be deformed to attenuate the pressure wave in the manifold channel 11; and a portion (second thin-walled portion), of the synthetic resin plate 73, which faces in a plan view with one of the through holes 74 can be deformed to attenuate the pressure wave in the manifold channel 12. Further, in this case, the spacer plate 72 is arranged between the synthetic resin plates 71 and 73, thereby making it possible to easily form a space (integrated damper chamber) in which the portions of the synthetic resin plates 71 and 73 are deformable, while precisely securing a gap for the deformation. Furthermore, the capacity to attenuate the pressure wave is uniform in the damper portion. It is preferable to use, as the synthetic resin used for the synthetic resin plates 71 and 73, a resin having a gas permeability resistance, or to perform a treatment for gas permeability resistance for the synthetic resin plates 71 and 73 at least for the areas facing the manifold channels 11 and 12.

Figure 7A:
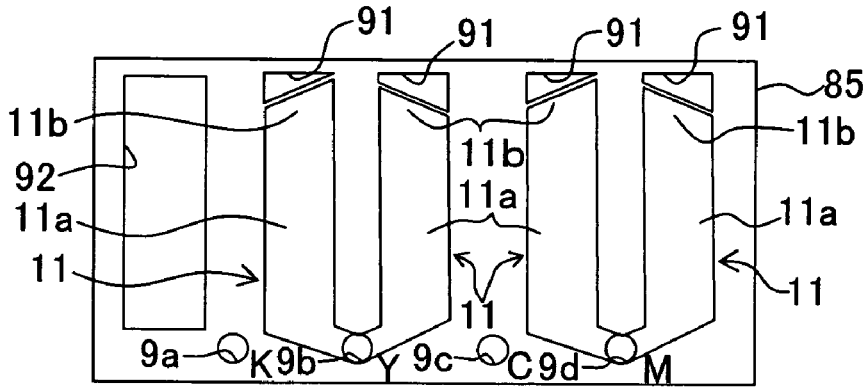
FIGS. 7A to 7D are sectional views of a second modification, corresponding to FIGS. 5A to 5D.
Figure 7B:
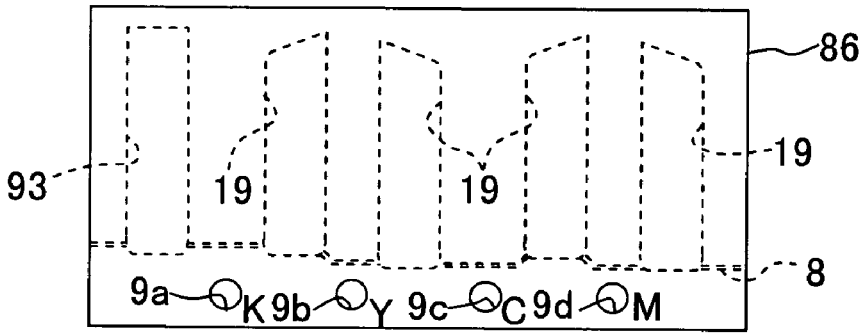
Figure 7C:
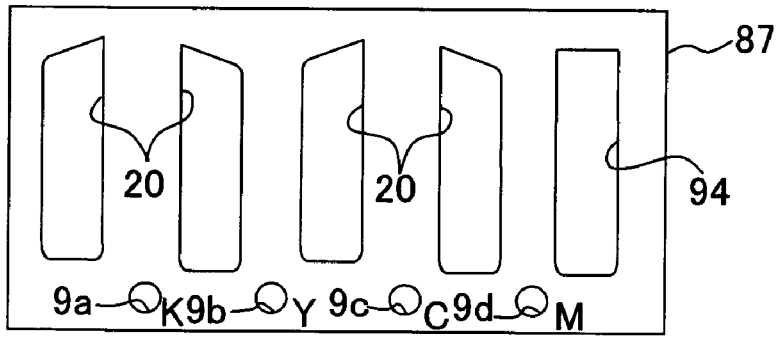
Figure 7D:
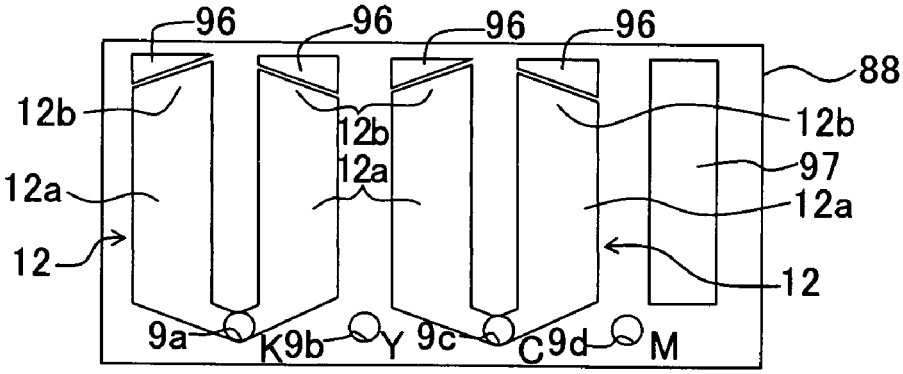

In a second modification, as shown in FIG. 7A, dummy manifold channels (third dummy common liquid chambers) 91 are formed in a manifold plate 85 at positions each of which is adjacent to the narrowing area 11*b*, of one of the manifold channels 11, in the extending direction of thereof. Further, as shown in FIG. 7D, dummy manifold channels (fourth dummy common liquid chambers) 96 are formed in a manifold plate 88 at positions each of which is adjacent to the narrowing area 12*b*, of one of the manifold channels 12, in the extending direction thereof. In this case, a sum of the width of the narrowing area 11*a* of each of the manifold channels 11 and the width of each of the dummy manifold channels 91 has a length which is same as the width of the constant-width area 11*a* of each of the manifold channel 11; and a sum of the width of the narrowing area 12*a* of each of the manifold channels 12 and the width of each of the dummy manifold channels 96 has a length which is same as the width of the constant-width area 12*a* of each of the manifold channel 12.

Further, as shown in FIG. 7A, a dummy manifold channel (first dummy common liquid chamber) 92 is formed in the manifold plate 85. The dummy manifold channel 92 has a rectangular planar shape which is substantially same as the shape formed by one of the manifold channels 11 and one of the dummy manifold channels 91. Furthermore, as shown in FIG. 7B, a recess 93 is formed in the damper plate 86 at a position overlapping in a plan view with the dummy manifold channel 92. The recess 93 has a rectangular planar shape which is substantially same as that of the dummy manifold channel 92. On the other hand, as shown in FIG. 7D, a dummy manifold channel (second dummy common liquid chamber) 97 is formed in the manifold plate 88. The dummy manifold channel 97 has a rectangular planar shape which is substantially same as the shape formed by one of the manifold channels 12 and one of the dummy manifold channels 96. Further, as shown in FIG. 7C, a recess 94 having a substantially rectangular planar shape similar to that of the dummy manifold channel 97 is formed in the damper plate 87 at a position overlapping in a plan view with the dummy manifold channel 97.

In this case, since the dummy manifold channels 91, 96 are formed, the rigidity around pressure chambers 10, which are included in the pressure chambers 10 (see FIG. 2) and which are located at positions on a side of the narrowing areas 11*b*, 12*b*, respectively, and disposed away (farther) from the ink inlet port 9*a* to 9*d*, is substantially same as the rigidity around other pressure chambers 10. Accordingly, the ink-jetting characteristics are made to be uniform among the nozzles 16 (see FIG. 2) communicating with the pressure chambers 10, respectively. In this case also, the spaces defined by the recesses 19 and 20, by the recesses 19 and 94, and by the recesses 20 and 93, respectively when the damper plates 86 and 87 are stacked, are communicated with the outside air via the air hole 8 formed in the damper plate 86. Accordingly, it is possible to prevent any unsatisfactory bonding between the damper plates 86 and 87 which would be otherwise caused by the air expansion in these spaces due to the heating in the production process, and to further prevent the channel unit from being broken.

In the embodiment and the modifications thereof as explained above, although the piezoelectric actuator 6 is an actuator utilizing the vertical piezoelectric effect, the actuator is not limited thereto. The actuator may be, for example, an unimorph-type actuator which utilizes the horizontal piezoelectric effect in combination with a vibration plate. In this case, when the vibration plate is an electrically conductive body, the vibration plate constructs a pair of electrodes together with one of individual electrodes arranged to face the vibration plate, sandwiching the piezoelectric layer therebetween. Alternatively, when the vibration plate is an insulative body, a common electrode may be arranged on the vibration plate. Still alternatively, it is allowable to adopt an actuator constructed by forming a pair of electrodes on a surface of the piezoelectric layer for each of the pressure chambers, and by alternately stacking a plurality of the piezoelectric layers sandwiched by the electrode pairs respectively. In this case, the slip displacement is caused by a structure in which a direction of the electric field and a direction in which the piezoelectric layer is polarized cross with each other.

In the embodiment and the modifications thereof as explained above, the piezoelectric actuator is employed as the energy applying mechanism. The energy applying mechanism, however, is not limited to the piezoelectric actuator. For example, it is allowable to provide, as the energy applying mechanism, a resistance wire which generates Joule heat in the pressure chambers by a drive signal. In this case, air bubbles are generated by heating and vaporizing the ink in the pressure chambers, and the ink can be jetted by the pressure exerted by the air bubbles.

Alternatively, in the damper chamber, a liquid may be filled therein instead of the air, provided that the liquid does not erode or alternate the thin-walled portion. Still alternatively, a porous resin having inner holes such as a sponge member or the like, may be filled in the damper chamber depending on a desired damper performance or property.

In the embodiment and the modifications thereof, the present invention is explained by an example in which the present invention is applied to an ink-jet head. The present invention, however, is also applicable to a liquid-droplet jetting apparatus which jets a liquid other than ink, such as reagent, biomedical solution, solution for wiring material, solution for electronic material, cooling medium, fuel, and the like.

What is claimed is:

1. A liquid-droplet jetting apparatus which has a body and which jets liquid droplets of a liquid, comprising:

a plurality of first pressure chambers;

a first pressure-chamber row in which the first pressure chambers are arranged in a first direction;

a plurality of second pressure chambers;

a second pressure-chamber row in which the second pressure chambers are arranged in the first direction;

a first common liquid chamber which extends in the first direction and which communicates with each of the first pressure chambers;

a second common liquid chamber which extends in the first direction and which communicates with each of the second pressure chambers; and a damper which extends in the first direction and which is located between the first common liquid chamber and the second common liquid chamber in a thickness direction of the body;

wherein the first common liquid chamber has a width in a second direction, which is orthogonal to the first direction, so as to overlap with the second common liquid chamber in the thickness direction;

wherein the damper has a width in the second direction so as to overlap with each of the first common liquid chamber and the second common liquid chamber in the thickness direction;

wherein each of the first common liquid chamber, the second common liquid chamber, and the damper has the width in the second direction so as to overlap in the thickness direction with the first pressure-chamber row and the second pressure-chamber row; and wherein the first pressure-chamber row and the second pressure-chamber row are arranged in the second direction with respect to each other.

2. The liquid-droplet jetting apparatus according to claim 1;

wherein the damper includes:

a first thin-walled portion which forms a wall surface of the first common liquid chamber;

a first damper chamber in which a part of a wall surface thereof is defined by the first thin-walled portion and which has rigidity lower than that of the first thin-walled portion;

a second thin-walled portion which forms a wall surface of the second common liquid chamber; and a second damper chamber in which a part of a wall surface thereof is defined by the second thin-walled portion and which has rigidity lower than that of the second thin-walled portion.

3. The liquid-droplet jetting apparatus according to claim 2;

wherein the first thin-wall portion defines the wall surface, of the first common chamber, which faces the second common liquid chamber;

wherein the second thin-wall portion defines the wall surface, of the second common chamber, which faces the first common liquid chamber; and wherein the first damper chamber and the second damper chamber are integrated to form an integrated damper chamber.

4. The liquid-droplet jetting apparatus according to claim 2;

wherein the first thin-walled portion is a thinned portion, in a first flat plate, defined by a first recess which is formed on a surface, of the first flat plate, opposite to the first common liquid chamber; and wherein the second thin-walled portion is a thinned portion, in a second flat plate, defined by a second recess which is formed on a surface, of the second flat plate, opposite to the second common liquid chamber.

5. The liquid-droplet jetting apparatus according to claim 3;

wherein a spacer is intervened between the first thin-walled portion and the second thin-walled portion; and wherein a thickness of the spacer is same as a thickness of the integrated damper chamber.

6. The liquid-droplet jetting apparatus according to claim 2;

wherein the first damper chamber and the second damper chamber communicate with outside air.

7. The liquid-droplet jetting apparatus according to claim 1;

wherein a plurality of first jetting ports communicating with the first pressure chambers respectively and a plurality of second jetting ports communicating with the second pressure chambers respectively are formed in a side surface of the body.

8. The liquid-droplet jetting apparatus according to claim 1;

wherein each of the first pressure chambers and each of the second pressure chambers are formed along a side surface of the body.

9. The liquid-droplet jetting apparatus according to claim 1, further comprising:

an energy applying mechanism which applies jetting energy to each of the first pressure chambers and to each of the second pressure chambers;

wherein the energy applying mechanism includes a piezoelectric layer which faces each of the first pressure chambers and each of the second pressure chambers, and a pair of electrodes which applies electric field to the piezoelectric layer.

10. The liquid-droplet jetting apparatus according to claim 2;

wherein the first common liquid chamber is formed as a plurality of first common liquid chambers arranged in the second direction;

wherein the first thin-walled portion is formed as a plurality of first thin-walled portions each of which forms a wall surface of one of the first common liquid chambers, and the first damper chamber is formed as a plurality of first damper chambers in each of which a portion of a wall surface thereof is defined by one of the first thin-walled portions;

wherein the second common liquid chamber is formed as a plurality of second common liquid chambers arranged in the second direction; and wherein the second thin-walled portion is formed as a plurality of second thin-walled portions each of which forms a wall surface of one of the second common liquid chambers, and the second damper chamber is formed as a plurality of second damper chambers in each of which a portion of a wall surface thereof is defined by one of the second thin-walled portions.

11. The liquid-droplet jetting apparatus according to claim 10;

wherein the liquid includes liquids of different kinds, and the liquids of different kinds are supplied to the first common liquid chambers and the second common liquid chambers, respectively.

12. The liquid-droplet jetting apparatus according to claim 10, further comprising:

a first dummy common liquid chamber which is adjacent to the first common liquid chambers in the second direction and which extends in the first direction;

a second dummy common liquid chamber which is adjacent to the second common liquid chambers in the second direction and which extends in the first direction;

a first dummy thin-walled portion which defines a wall surface of the first dummy common liquid chamber;

a first dummy damper chamber in which a part of a wall surface thereof is defined by the first dummy thin-walled portion and which has rigidity lower than that of the first dummy thin-walled portion;

a second dummy thin-walled portion which defines a wall surface of the second dummy common liquid chamber; and a second dummy damper chamber in which a part of a wall surface thereof is defined by the second dummy thin-walled portion and which has rigidity lower than that of the second dummy thin-walled portion;

wherein one of the second common liquid chambers has a width in the second direction so as to overlap at least partially with the first dummy common liquid chamber in the thickness direction; and wherein one of the first common liquid chambers has a width in the second direction so as to overlap at least partially with the second dummy common liquid chamber in the thickness direction.

13. The liquid-droplet jetting apparatus according to claim 12;

wherein each of the first common liquid chamber and the second common liquid chamber and each of the first dummy common liquid chamber and the second dummy common liquid chamber has a constant-width area in which a length in the second direction is constant, and a narrowing area which is continued to the constant-width area and in which a length in the second direction is reduced toward an end in the first direction of the narrowing area.

14. The liquid-droplet jetting apparatus according to claim 13, further comprising:

a plurality of third dummy common liquid chambers each of which is adjacent, in the first direction, to the narrowing area of one of the first common liquid chambers;

a plurality of fourth dummy common liquid chambers each of which is adjacent, in the first direction, to the narrowing area of one of the second common liquid chambers;

wherein a sum of a length, of each of the third dummy common liquid chambers, in the second direction and a length, of the narrowing area of each of the first common liquid chambers, in the second direction, is substantially same as the length in the second direction of the constant-width area of each of the first common liquid chambers; and wherein a sum of a length, of each of the fourth dummy common liquid chambers, in the second direction and a length, of the narrowing area of each of the second common liquid chambers, in the second direction, is substantially same as the length in the second direction of the constant-width area of each of the second common liquid chambers.

15. A liquid-droplet jetting apparatus which has a body and which jets liquid droplets of a liquid, the apparatus comprising:

a plurality of first pressure chambers;

a first pressure-chamber row in which the first pressure chambers are arranged in a first direction;

a plurality of second pressure chambers;

a second pressure-chamber row in which the second pressure chambers are arranged in the first direction;

a first common liquid chamber which extends in the first direction and which communicates with each of the first pressure chambers;

a second common liquid chamber which extends in the first direction and which communicates with each of the second pressure chambers; and a damper which extends in the first direction and which is located between the first common liquid chamber and the second common liquid chamber in a thickness direction of the body;

wherein each of the first pressure chambers and each of the second pressure chambers extends in a second direction orthogonal to the first direction;

wherein the first common liquid chamber has a width in the second direction so as to overlap with the second common liquid chamber in the thickness direction;

wherein the damper has a width in the second direction so as to overlap with each of the first common liquid chamber and the second common liquid chamber in the thickness direction;

wherein each of the first common liquid chamber, the second common liquid chamber, and the damper has the width in the second direction which is greater than a length, of one of the first pressure chambers, in the second direction and which is greater than a length, of one of the second pressure chambers, in the second direction; and wherein the first pressure-chamber row and the second pressure-chamber row are arranged in the second direction with respect to each other.

16. The liquid-droplet jetting apparatus according to claim 15;

wherein the width in the second direction of each of the first common liquid chamber, the second common liquid chamber and the damper is substantially same as a sum of the length in the second direction of one of the first pressure chambers and the length in the second direction of one of the second pressure chambers.

17. The liquid-droplet jetting apparatus according to claim 15;

wherein the damper has the width in the second direction so that the damper overlaps in the thickness direction substantially entirely with a portion in which the first common liquid chamber and the second common liquid chamber are overlapped in the thickness direction.

18. The liquid-droplet jetting apparatus according to claim 15;

wherein the damper communicates with outside air via an air hole.

19. The liquid-droplet jetting apparatus according to claim 15;

wherein the first common liquid chamber is formed as a plurality of first common liquid chambers arranged in the second direction;

wherein the second common liquid chamber is formed as a plurality of second common liquid chambers arranged in the second direction; and wherein the damper is formed as a plurality of dampers which extend in the first direction and each of which is located, in the thickness direction of the body, between one of the first common liquid chambers and one of the second common liquid chambers.

20. The liquid-droplet jetting apparatus according to claim 19;

wherein the dampers communicate with outside air via an air hole.

* * * * *